US005733859A

United States Patent [19]

Carrie et al.

[11] Patent Number: 5,733,859

[45] Date of Patent: Mar. 31, 1998

[54] MALEIC ACID-BASED AQUEOUS CLEANING COMPOSITIONS AND METHODS OF USING SAME

[75] Inventors: Michel Jean Carrie, Strombeek-Bever; Axel Koenig, Wemmel; Eddy Vos, Linden, all of Belgium

[73] Assignee: The Procter & Gamble Company, Cincinnati, Ohio

[21] Appl. No.: 687,416

[22] PCT Filed: Feb. 2, 1995

[86] PCT No.: PCT/US95/01298

§ 371 Date: Sep. 11, 1996

§ 102(e) Date: Sep. 11, 1996

[87] PCT Pub. No.: WO95/21230

PCT Pub. Date: Aug. 10, 1995

[30] Foreign Application Priority Data

Feb. 3, 1994 [EP] European Pat. Off. ..... 94870021

[51] Int. Cl.[6] ..... C11D 3/04; C11D 3/20; C11D 10/02; C11D 17/00

[52] U.S. Cl. ..... 510/362; 510/238; 510/245; 510/247; 510/253; 510/254; 510/269; 510/365; 510/421; 510/423; 510/433; 510/434; 510/477; 510/488; 510/494; 510/496; 510/497; 510/504; 510/506

[58] Field of Search ..... 510/362, 365, 510/245, 247, 254, 269, 253, 421, 423, 433, 434, 477, 488, 494, 496, 497, 504, 506, 238

[56] References Cited

U.S. PATENT DOCUMENTS

| | | | |
|---|---|---|---|
| 3,277,008 | 10/1966 | Heit | 252/82 |
| 3,915,633 | 10/1975 | Ramachandran | 8/137 |
| 3,954,630 | 5/1976 | Ramachandran | 442/93 |
| 4,351,673 | 9/1982 | Lawson | 134/3 |
| 4,381,950 | 5/1983 | Lawson | 134/3 |
| 4,749,508 | 6/1988 | Cockrell, Jr. et al. . | |
| 4,959,105 | 9/1990 | Neidiffer et al. | 134/3 |
| 5,656,580 | 8/1997 | Carrie et al. | 510/362 |

FOREIGN PATENT DOCUMENTS

| | | |
|---|---|---|
| 528029 | 4/1983 | Australia . |
| 4-332799 | 11/1992 | Japan . |
| 1 476 840 | 6/1977 | United Kingdom . |

*Primary Examiner*—Ardith Hertzog
*Attorney, Agent, or Firm*—Robert B. Aylor

[57] ABSTRACT

Acidic aqueous cleaning compositions containing a strong acid and maleic acid are disclosed. The maleic acid provides improved surface safety.

10 Claims, 1 Drawing Sheet

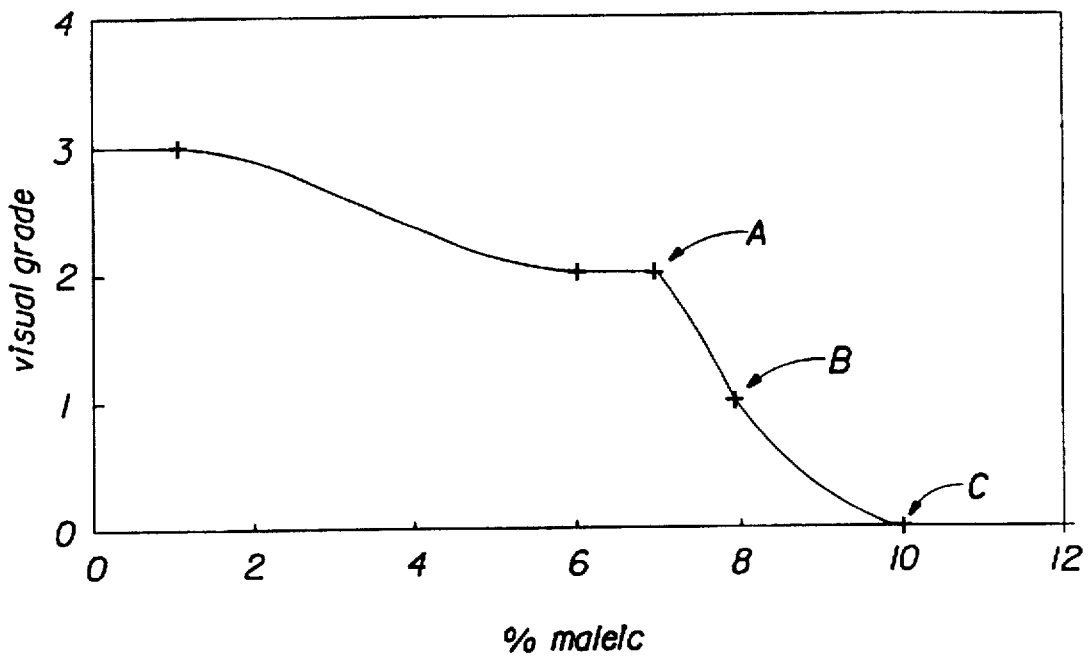
4
3
2
1
0
visual grade
A
B
C
0
2
4
6
8
10
12
% maleic

MALEIC ACID-BASED AQUEOUS CLEANING COMPOSITIONS AND METHODS OF USING SAME

TECHNICAL FIELD

The present invention relates to cleaning compositions for hard-surfaces. More specifically, compositions are described which give optimal performance in removing limescale stains and encrustations while ensuring appropriate surface safety, especially when used for cleaning and descaling metal surfaces.

BACKGROUND

Tap water contains a certain amount of solubilized ions which upon water evaporation eventually deposit as salts such as calcium carbonate on surfaces which are often in contact with said water, resulting in an unaesthetic aspect of said surfaces. This limescale formation and deposition phenomenon is even more acute in places where water is particularly hard.

It is well known in the art that limescale can be removed chemically with acidic solutions, and a great variety of acidic cleaning compositions have been described for this purpose.

However, in many instances acidic compositions may cause the problem that the acids which are used damage the surfaces being treated. In particular, some corrosion/staining may occur when metal surfaces such as aluminium, chromed steel or stainless steel are treated with such acids.

It is therefore an object of the present invention to obviate this issue in providing a cleaning composition for the removal of limescale, said composition possessing a superior limescale removing capacity while being also safe to metal surfaces.

It has now been found that for an acid which has a first pKa not exceeding 5, surface safety is improved without compromising on limescale removing capacity by combining said acid or mixtures thereof with maleic acid, in appropriate ratios. Indeed, it has been found that the compositions of the present invention comprising maleic acid and such an acid in appropriate ratios are significantly safer to metal surfaces than the same compositions without maleic acid, while being also particularly effective in removing limescale.

An advantage of this invention is that said compositions are also safe to other surfaces besides metal surfaces including synthetic surfaces.

U.S. Pat. No. 3,277,008 discloses solid compositions suitable for use with water to form aqueous solutions for descaling the internal metal surfaces of the jacket of the glass-lined jacketed equipment. Said compositions comprise a cleaning agent such as sulfamic or hydrochloric acid, maleic acid and a corrosion inhibitor. Surfactants are not disclosed.

DE-3,822,658 discloses compositions useful for removing oxide layers from metal surfaces like copper or bronze. Said compositions comprise a mineral acid for example nitric acid, a carboxylic acid such as maleic acid, phosphonic acid and thioureas. Nonionic surfactants are disclosed as optional ingredients without specifying appropriate amounts.

EP-A-0,496,188 discloses a composition comprising nonionic surfactants together with maleic acid whereby good limescale removal is provided. Citric acid is disclosed together with maleic acid in some of the examples. But citric acid is not effective in removing limescale at low pH.

SUMMARY OF THE INVENTION

The present invention is an aqueous cleaning composition having a pH of from 0.1 to 4.5, suitable for removing limescale from hard-surfaces, comprising from 0.01% to 30% by weight of the total composition of a surfactant or mixtures thereof, maleic acid and an acid which has a first pKa not exceeding 5, with the exception of citric acid, or mixtures thereof, in a weight ratio of maleic acid to said acid such that surface safety is improved.

The present invention also encompasses a process of treating hard-surfaces, especially metal surfaces, wherein a composition according to the present invention is used in its neat or diluted form.

BRIEF DESCRIPTION OF THE DRAWING

FIG. 1 is a graphical representation of the effect on surface appearance of an aqueous solution containing about 3% sulfamic acid containing various levels of maleic acid.

DETAILED DESCRIPTION OF THE INVENTION

The compositions according to the present invention are designed for removing limescale or soils comprising limescale as an essential component. Thus they comprise as a first essential ingredient an acid which has a first pKa not exceeding 5 or mixtures thereof. Preferably the acids to be used herein which are particularly efficient to remove limescale on many surfaces, have their first pKa not exceeding 4, more preferably not exceeding 3 and most preferably below 2. According to the present invention said acids can be organic or inorganic acids. Examples of inorganic acids are sulfamic acid (pKa=0.1), hydrochloric acid (pKa<0), nitric acid (pKa<0), phosphoric acid (pKa=2.1) and methanesulfonic acid (pKa=1.9). An example of organic acid is formic acid (pKa=3.75). Preferred for use herein is sulfamic acid alone or in mixture with another acid. Furthermore, the compositions according to the present invention are free of citric acid which does not perform very well as a limescale remover at pH below 2. The compositions of the present invention comprise from 0.1% to 20% by weight of the total composition of an acid which has a first pKa not exceeding 5 or mixtures thereof, preferably from 0.1% to 10% and more preferably from 0.1% to 5%.

The compositions according to the present invention further comprise maleic acid as the second essential ingredient. The compositions according to the present invention comprise from 0.1% to 45% by weight of the total composition of maleic acid, preferably from 1% to 25% amd more preferably from 8% to 20%. This percentage is calculated on the basis of the molecular weight of the acid form, but maleic anhydride is equally convenient for use in the compositions according to the present invention. Indeed maleic anhydride is generally cheaper and it is transformed into the acid form when incorporated in an aqueous medium.

It has been observed that surface safety is improved when treating metal surfaces with the compositions of the present invention comprising maleic acid and an acid having its first pKa not exceeding 5, in an appropriate weight ratio of one to the other. Said ratio is dependent on the specific acid used and thus is different for each acid or each mixture thereof. According to the present invention the weight ratio of maleic acid to said acid is such that the surface safety is improved. By "surface safety improvement" it is to be understood that less damage to the surface treated is observed with the compositions of the present invention compared to the same compositions without maleic acid, this at a given time of contact. More specifically, we have observed that by plotting the surface damage against the amount of maleic, in any given composition comprising an acid having its first pKa not exceeding 5, a curve is obtained which comprises a step (see FIG. 1). The surface safety is "improved" when the step is reached (A), preferably half the step (B) and more preferably the whole of the step (C). A method suitable for measuring surface safety is a visual grading method mentioned hereinafter in the examples. Said surface safety test method is reported in the literature in ANSI 124.1-1980.

In a preferred embodiment of the present invention, the compositions herein comprise sulfamic acid as said acid having its first pKa not exceeding 5. Preferably said compositions comprise from 0.5% to 5% by weight of the total composition of said sulfamic acid with a weight ratio of maleic acid to said sulfamic acid of from 15:1 to 3:1, preferably of from 8:1 to 4:1.

The compositions according to the present invention have a pH of from 0.1 to 4.5, preferably of from 0.1 to 3 and more preferably of from 0.5 to 2.

The compositions according to the present invention comprise as a further essential ingredient a surfactant or mixtures thereof. Preferably the compositions according to the present invention comprise from 0.01% to 30% by weight of the total composition of said surfactant or mixtures thereof, more preferably from 0.05% to 10%, more preferably from 0.1% to 8% and most preferably from 0.1% to 3%. All types of surfactants may be used in the present invention including nonionic, anionic, cationic, amphoteric or zwitterionic surfactants. It is also possible to use mixtures of such surfactants without departing from the spirit of the present invention.

Suitable nonionic surfactants to be used herein are alkoxylated alcohol nonionic surfactants which can be readily made by condensation processes which are well known in the art. However, a great variety of such alkoxylated alcohols, especially ethoxylated and/or propoxylated alcohols is also conveniently commercially available. Surfactants catalogs are available which list a number of surfactants, including nonionics.

Accordingly, preferred alkoxylated alcohols for use herein are nonionic surfactants according to the formula RO(E)e(P)pH where R is a hydrocarbon chain of from 2 to 24 carbon atoms, E is ethylene oxide and P is propylene oxide, and e and p which represent the average degree of, respectively ethoxylation and propoxylation, are of from 0 to 24. The hydrophobic moiety of the nonionic compound can be a primary or secondary, straight or branched alcohol having from 8 to 24 carbon atoms. Preferred nonionic surfactants for use in the compositions according to the invention are the condensation products of ethylene oxide with alcohols having a straight alkyl chain, having from 6 to 22 carbon atoms, wherein the degree of ethoxylation is from 1 to 15, preferably from 5 to 12. Such suitable nonionic surfactants are commercially available from Shell, for instance, under the trade name Dobanol® or from Shell under the trade name Lutensol®. These nonionics are preferred because they have been found to allow the formulation of a stable product without requiring the addition of stabilizers or hydrotopes. When using other nonionics, it may be necessary to add hydrotopes such as cumene sulphonate or solvents such as butyldiglycolether.

Suitable anionic surfactants for use herein are according to the formula $R_1SO_3M$ wherein $R_1$ represents a hydrocarbon group selected from the group consisting of straight or branched alkyl radicals containing from 6 to 24 carbon atoms and alkyl phenyl radicals containing from 6 to 15 carbon atoms in the alkyl group. M is a salt forming cation which typically is selected from the group consisting of sodium, potassium, ammonium, and mixtures thereof.

Other suitable anionic surfactants can be represented by the water-soluble salts of an alkyl sulfate or an alkyl polyethoxylate ether sulfate wherein the alkyl group contains from 6 to 24 carbon atoms, and preferably from 1 to 30 ethoxy groups for the alkyl polyethoxylate ether sulfates.

Suitable cationic surfactants to be used herein include derivatives of quaternary ammonium, phosphonium, imidazolium and sulfonium compounds. Preferred cationic surfactants for use herein are according to the formula $R_1R_2R_3R_4N^+ X^-$, wherein X is a counteranion, $R_1$ is a $C_8$–$C_{20}$ hydrocarbon chain and $R_2$, $R_3$ and $R_4$ are independently selected from H or $C_1$–$C_4$ hydrocarbon chains. In a preferred embodiment of the present invention, $R_1$ is a $C_{12}$–$C_{18}$ hydrocarbon chain, most preferably $C_{14}$, $C_{16}$or $C_{18}$, and $R_2$, $R_3$ and $R_4$ are all three methyl, and X is halogen, preferably bromide or chloride, most preferably bromide. Examples of cationic surfactants are stearyl trimethyl ammonium bromide (STAB), cetyl trimethyl ammonium bromide (CTAB) and myristyl trimethyl ammonium bromide (MTAB).

Suitable zwitterionic surfactants contain both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used. A generic formula for some preferred zwitterionic surfactants is $$R_1-N^+(R_2)(R_3)R_4X^-$$

wherein $R_1$ is a hydrophobic group; $R_2$ and $R_3$ are each $C_1$–$C_4$ alkyl, hydroxy alkyl or other substituted alkyl group which can also be joined to form ring structures with the N; $R_4$ is a moiety joining the cationic nitrogen atom to the hydrophilic group and is typically an alkylene, hydroxy alkylene, or polyalkoxy group containing from 1 to 4 carbon atoms; and X is the hydrophilic group which is preferably a carboxylate or sulfonate group. Preferred hydrophobic groups $R_1$ are alkyl groups containing from 8 to 22, preferably less than 18, more preferably less than 16 carbon atoms. The hydrophobic group can contain unsaturation and/or substituents and/or linking groups such as aryl groups, amido groups, ester groups and the like. In general, the simple alkyl groups are preferred for cost and stability reasons.

Other specific zwitterionic surfactants have the generic formulas:

$$R_1—C(O)—N(R_2)—(C(R_3)_2)_n—N(R_2)_2(+)—(C(R_3)_2)_n—SO_3(-)$$

or $$R_1—C(O)—N(R_2)—(C(R_3)_2)_n—N(R_2)_2^{(+)}—(C(R_3)_2)_n—COO(-)$$

wherein each $R_1$ is a hydrocarbon, e.g. an alkyl group containing from 8 up to 20, preferably up to 18, more preferably up to 16 carbon atoms, each $R_2$ is either a hydrogen (when attached to the amido nitrogen), short chain alkyl or substituted alkyl containing from one to 4 carbon atoms, preferably groups selected from the group consisting of methyl, ethyl, propyl, hydroxy substituted ethyl or propyl and mixtures thereof, preferably methyl, each $R_3$ is selected from the group consisting of hydrogen and hydroxy groups and each n is a number from 1 to 4, preferably from 2 to 3, more preferably 3, with no more than one hydroxy group in any $(C(R_3)_2)$ moiety. The $R_1$ groups can be branched and/or unsaturated. The $R_2$ groups can also be connected to form ring structures. A surfactant of this type is a $C_{10}$–$C_{14}$ fatty acylamidopropylene(hydroxypropylene)sulfobetaine that is available from the Sherex Company under the trade name "Varion CAS sulfobetaine"®.

Suitable amphoteric surfactants are surfactants which are similar to the zwitterionic surfactants but without the quaternary group. However, they contain an amine group that is protonated at the low pH of the composition to form cationic group and they may also possess an anionic group at these pHs.

In one embodiment of the present invention where it is desirable to give some viscosity to the compositions of the present invention the surfactant is a mixture of a nonionic surfactant as described hereinbefore together with a cationic surfactant as described hereinbefore. Said compositions comprise from 0.5% to 15% by weight of the total composition of said mixture of surfactant.

The compositions according to the present invention are aqueous. Accordingly, the compositions according to the present invention comprise from 10% to 95% by weight of the total composition of water, preferably from 50% to 90%, most preferably from 70% to 85%.

The compositions according to the present invention may further comprise a variety of other ingredients including perfumes, colorants, bactericide, thickeners, dyes, chelants, pigments, solvents, stabilizers, corrosion inhibitors and the like.

In one embodiment, the compositions of the present invention are free of corrosion inhibitors, i.e. compounds which have the sole purpose of inhibiting corrosion.

The compositions according to the present invention are particularly suitable for treating metal surfaces which can be found in a kitchen or in a bathroom. Indeed, the compositions of the present invention exhibit good limescale removing properties for both the kitchen-type stains and the bathroom-type stains, i.e. for stains which contain not only calcium carbonate but also soap scum and/or grease.

The compositions according to the present invention are also suitable for treating metal surfaces which can be found in appliances such as for example irons, coffee machines or kettles. The compositions to be used in the application of descaling appliances preferably contain low levels of surfactants, preferably below 1% by weight of the total composition and more preferably from 0.1% to 0.9%. In the application of descaling appliances it is preferred to use the cationic surfactants described hereinbefore as the surfactant.

The present invention further encompasses a process of treating hard-surfaces, especially metal surfaces, wherein a composition as hereinbefore defined is dispensed in its neat form from a container onto said surfaces, then left to act onto said surfaces and then removed by rinsing. Said process can be used both for treating metal surfaces found in bathrooms, kitchens or appliances.

The present invention further encompasses a process of treating hard-surfaces, especially metal surfaces, wherein a composition as hereinbefore defined is used in diluted form. The expression "used in diluted form" herein includes dilution by the user, which occurs for instance in the application of descaling appliances. Typical dilution levels are of from 0.5% to 50% of the compositions. The compositions herein are also particularly suitable to be used in hot conditions, e.g. when descaling a coffee machine said compositions can be used diluted and in hot conditions (80° C. to 180° C.).

As used in the foregoing paragraphs, the expression "treating" may include washing as the compositions according to the present invention comprise surfactants and removing limescale while improving surface safety due to the appropriate combination of acids of the present invention.

The present invention is further illustrated by the following experimental data and examples.

EXPERIMENTAL DATA

1)

The surface safety of solutions comprising 3% of sulfamic acid (pKa=0.1) together with increasing percentages of maleic acid is evaluated by the following surface safety test method.

The surface safety test method is conducted on an aluminium surface. A drop of the solution to be tested is put onto said surface and left there for 16 hours. In this test the drop of the solution is left to dry at room temperature (20° C.). At the end of the exposure time, the surface is rinsed with soft water and wiped dry. The same surface without any treatment is taken as a reference. The comparison between the surface treated and untreated is done visually using the following grading scale:

0=no visual surface damage

1=slight surface change/damage; weak staining

2=slightly more surface damage; medium staining

3=lots of surface damage; strong staining.

As a result the curve in FIG. 1 was obtained reporting the visual surface damage against the increase of the percentage of maleic acid by weight of a total solution comprising 3% of sulfamic acid.

The curve in FIG. 1 shows that surface safety is improved when maleic acid and sulfamic acid are present in appropriate ratios of one to the other.

2)

Further examples of compositions according to the present invention are the following. These compositions are made comprising the listed ingredients in the listed proportions (weight %).

| Ingredients: | Compositions | | | | |
|---|---|---|---|---|---|
| (% by weight) | 1 | 2 | 3 | 4 | 5 |
| Maleic acid | 8 | 8 | 14 | 14 | 14 |
| Sulfamic acid | / | / | 2 | 2 | 2 |
| Nitric acid | / | 0.5 | / | / | / |
| Formic acid | 4 | / | / | / | / |
| Lutensol AO7* | 3 | 3 | 3 | 0.3 | / |
| Cetyl trimethyl ammonium bromide** | / | / | / | / | 0.3 |
| Waters & Minors | | | up to 100 | | |
| Exposure (hours) | 22 | 5 | 17 | 24 | 24 |

*Lutensol AO7 is a nonionic surfactant.
**Cetyl trimethyl ammonium bromide is a cationic surfactant.

The surface safety test method as described hereinbefore has been conducted for compositions 1 to 5, on an aluminium surface and a stainless steel surface with an exposure of different time period as indicated hereinbefore. No visual difference has been found for the compositions 1 to 5 when comparing the surfaces treated with the reference surface (untreated). In other words, these compositions are safe to both the aluminium and stainless steel surfaces.

Furthermore no damage to an aluminium or a stainless steel surface has been observed when conducting the surface safety test method in hot conditions, i.e. bowling point temperature of the compositions tested, with compositions 4 and 5 for an exposure period time of 0.5 hours.

What is claimed is:

1. An aqueous cleaning composition having a pH of from about 0.1 to about 4.5, suitable for removing limescale deposits on hard surfaces, comprising from about 0.1% to about 30% of surfactant, or mixtures thereof; from about 0.5% to about 5% of sulfamic acid; and a level of maleic acid to provide a weight ratio of maleic acid to sulfamic acid of from about 15:1 to about 3:51.

2. A composition according to claim 1 wherein the surfactant is selected from the group consisting of nonionic, anionic, cationic zwitterionic, amphoteric surfactants and mixtures thereof.

3. A composition according to claim 1 wherein the suffactant is a nonionic surfactant which is a condensation product of ethylene oxide with an alcohol, said alcohol having a straight alkyl chain comprising from about 6 to about 22 carbon atoms, said condensation product having a degree of ethoxylation of from about 1 to about 15, or mixtures thereof.

4. A composition according to claim 1 wherein the surfactant is a cationic surfactant according to the formula $R_1R_2R_3R_4N^+X^-$, wherein X is a counteranion, $R_1$ is a $C_8$–$C_{20}$ hydrocarbon chain and $R_2$, $R_3$ and $R_4$ are independently H or $C_1$–$C_4$ hydrocarbon chains.

5. A composition according to claim 1 wherein the surfactant is a mixture of a nonionic surfactant with a cationic surfactant according to the formula $R_1R_2R_3R_4N^+X^-$, wherein X is a counteranion, $R_1$ is a $C_8$–$C_{20}$ hydrocarbon chain and $R_2$, $R_3$ and $R_4$ are independently H or $C_1$–$C_4$ hydrocarbon chains.

6. A composition according to claim 1 wherein the pH is from about 0.1 to about 3.

7. A composition according to claim 1 wherein the pH is from about 0.5 to about 2.

8. A composition according to claim 1 wherein the weight ratio of maleic acid to said acid is from about 8:1 to about 4:1.

9. A process of treating hard-surfaces, wherein a composition according to claim 1 is dispensed in its neat form from a container or used in a diluted form onto said surfaces, then left to act onto said surfaces and then removed by rinsing, thereby improving surface safety.

10. A process according to claim 9 wherein the hard-surfaces are metal surfaces.

* * * * *